US007382862B2

(12) United States Patent
Bard et al.

(10) Patent No.: US 7,382,862 B2
(45) Date of Patent: Jun. 3, 2008

(54) X-RAY TUBE CATHODE WITH REDUCED UNINTENDED ELECTRICAL FIELD EMISSION

(75) Inventors: Erik C. Bard, Orem, UT (US); Charles R. Jensen, American Fork, UT (US); Shaun P. Ogden, Pleasant Grove, UT (US); Steven D. Liddiard, Provo, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 11/540,133

(22) Filed: Sep. 28, 2006

(65) Prior Publication Data

US 2007/0076849 A1 Apr. 5, 2007

Related U.S. Application Data

(60) Provisional application No. 60/722,738, filed on Sep. 30, 2005.

(51) Int. Cl.
*H01J 35/00* (2006.01)
*H01J 35/06* (2006.01)
*H01J 35/14* (2006.01)

(52) U.S. Cl. ..... 378/121; 378/137; 378/138

(58) Field of Classification Search ..... 378/121, 378/136–138, 142
See application file for complete search history.

(56) References Cited

U.S. PATENT DOCUMENTS 2,291,948 A * 8/1942 Cassen ..... 378/138
2,316,214 A * 4/1943 Atlee et al. ..... 378/138
2,329,318 A * 9/1943 Atlee et al. ..... 378/200
2,683,223 A * 7/1954 Hosemann ..... 378/138
2,952,790 A * 9/1960 Steen ..... 378/139
4,160,311 A 7/1979 Ronde et al.
4,463,338 A 7/1984 Utner et al.
4,679,219 A * 7/1987 Ozaki ..... 378/121
5,010,562 A 4/1991 Hernandez et al.
5,077,771 A * 12/1991 Skillicorn et al. ..... 378/102
5,105,456 A * 4/1992 Rand et al. ..... 378/125
5,117,829 A 6/1992 Miller et al.
5,161,179 A 11/1992 Suzuki et al.
5,226,067 A 7/1993 Allred et al.
RE34,421 E 10/1993 Parker et al.
5,391,958 A 2/1995 Kelly
5,400,385 A 3/1995 Blake et al.
5,428,658 A 6/1995 Oettinger et al.

(Continued)

FOREIGN PATENT DOCUMENTS

DE 10 30 936 5/1958

(Continued)

*Primary Examiner*—Edward J. Glick
*Assistant Examiner*—Anastasia Midkiff
(74) *Attorney, Agent, or Firm*—Thorpe North & Western

(57) ABSTRACT

An x-ray source has an evacuated tube. An anode is disposed in the tube and includes a material configured to produce x-rays in response to impact of electrons. A cathode is disposed in the tube opposing the anode configured to produce electrons accelerated towards the anode in response to an electric field between the anode and the cathode. A flange extends from the cathode toward the anode, and has a smaller diameter than the evacuated tube. The flange extends closer to the anode than an interface between the cathode and the tube thus forming a reduced-field region between the evacuated tube and the flange.

24 Claims, 4 Drawing Sheets

U.S. PATENT DOCUMENTS

| | | | | | |
|---|---|---|---|---|---|
| 5,469,490 | A | * | 11/1995 | Golden et al. | 378/122 |
| 5,478,266 | A | | 12/1995 | Kelly | |
| RE35,383 | E | | 11/1996 | Miller et al. | |
| 5,621,780 | A | | 4/1997 | Smith et al. | |
| 5,696,808 | A | * | 12/1997 | Lenz | 378/121 |
| 5,729,583 | A | | 3/1998 | Tang et al. | |
| 5,812,632 | A | * | 9/1998 | Schardt et al. | 378/137 |
| 6,005,918 | A | | 12/1999 | Harris et al. | |
| 6,044,130 | A | | 3/2000 | Inazura et al. | |
| 6,069,278 | A | | 5/2000 | Chuang | |
| 6,075,839 | A | | 6/2000 | Treseder | |
| 6,097,790 | A | | 8/2000 | Hasegawa et al. | |
| 6,133,401 | A | | 10/2000 | Jensen | |
| 6,134,300 | A | * | 10/2000 | Trebes et al. | 378/136 |
| 6,184,333 | B1 | | 2/2001 | Gray | |
| 6,288,209 | B1 | | 9/2001 | Jensen | |
| 6,307,008 | B1 | | 10/2001 | Lee et al. | |
| 6,320,019 | B1 | | 11/2001 | Lee et al. | |
| 6,351,520 | B1 | | 2/2002 | Inazaru | |
| 6,477,235 | B2 | | 11/2002 | Chornenky et al. | |
| 6,487,272 | B1 | | 11/2002 | Kutsuzawa | |
| 6,546,077 | B2 | | 4/2003 | Chornenky et al. | |
| 6,661,876 | B2 | * | 12/2003 | Turner et al. | 378/138 |
| 6,819,741 | B2 | * | 11/2004 | Chidester | 378/136 |
| 2006/0269048 | A1 | * | 11/2006 | Cain | 378/142 |

FOREIGN PATENT DOCUMENTS

| | | |
|---|---|---|
| DE | 44 30 623 | 3/1996 |
| DE | 198 18 057 | 11/1999 |
| EP | 0 297 808 | 1/1989 |
| EP | 0 330 456 | 8/1989 |
| GB | 1 252 290 | 11/1971 |
| JP | 57 082954 | 8/1982 |
| JP | 5066300 | 3/1993 |
| JP | 06 119893 | 7/1994 |

* cited by examiner

X-RAY TUBE CATHODE WITH REDUCED UNINTENDED ELECTRICAL FIELD EMISSION

PRIORITY CLAIM

Priority is claimed to U.S. Provisional Patent Application Ser. No. 60/722,738, filed on Sep. 30, 2005; which is herein incorporated by reference.

BACKGROUND OF THE INVENTION

1. Field of the Invention

The present invention relates generally to X-ray tube sources, such as mobile, miniature X-ray tube sources, and more particularly to the geometry of the cathode used in a miniature X-ray tube to reduce unintended electrical field emissions.

2. Related Art

In an X-ray tube, electrons emitted from a cathode source are attracted to an anode by the high bias voltage applied between these two electrodes. The intervening space must be evacuated to avoid electron slowing and scattering, and also to prevent ionization of containment gas and acceleration of the resulting ions to the cathode where they erode the filament and limit tube life. Characteristic and Bremsstrahlung X rays are generated by electron impact on the anode target material. Every material is relatively transparent to its own characteristic radiation, so if the target is thin, there may be strong emission from the surface of the target that is opposite the impacted surface. This arrangement is termed a transmission type X-ray tube.

Miniature transmission type X-ray tubes have been developed that are highly mobile. Current mobile, miniature x-ray sources use a low-power consumption cathode element for mobility, and an anode optic for creating a field free region to prolong the life of the cathode element. These miniature x-ray sources have an electric field that is applied to the anode and cathode which are disposed on opposite sides of an evacuated tube. The anode includes a target material that produces x-rays in response to impact of electrons. The cathode includes a cathode element to produce electrons which are accelerated towards the anode in response to an electric field between the anode and the cathode.

In such miniature x-ray sources the evacuated tube or bulb is an elongated cylinder that is formed of a ceramic material, such as aluminum oxide. The cathode is attached at an end of the tube and the anode is attached at an opposite end of the tube. The cathode is formed of a metal material and is attached by brazing the cathode to the ceramic tube. The joint between the cathode and the tube forms what is known as the triple point interface where the ceramic cylinder, the metal cathode, and the brazing material intersect.

A relatively high electric field is maintained between the cathode and the anode in order to accelerate electrons from the cathode toward the anode. Extremely high electric fields may exist upon certain features of the device, causing electrical arcing between the opposing electrodes. These particularly tend to originate from the interface between metallic cathode components, insulative structure, and vacuum in the device interior. Aside from arcing, the trajectory of the primary electron beam responsible for x-ray generation can be altered due to the presence of unintended stray charge generated at the same metal-dielectric-vacuum interface, often termed the "triple point".

Current miniature x-ray tube geometry places the triple point in a region subject to high electric field intensity, taking no particularly effective measure to avoid the aforementioned adverse effects. Thus, arcing between the cathode and anode and unintended field emission are likely to occur, compromising the performance and shortening the life of the device as a whole. Electrons from the field flow to be deflected by the triple point interface resulting in a distorted or misdirected electron beam and subsequent x-ray emission pattern.

SUMMARY OF THE INVENTION

It has been recognized that it would be advantageous to develop a cathode for use in a mobile, miniature x-ray source that locates the triple point interface out of the region of highest electric fields to prevent arcing between the cathode and anode electrodes and the generation of extraneous, field-emitted charge. Additionally, it has been recognized that it would be advantageous to develop a cathode for a mobile, miniature x-ray source that would manage flow of the braze material, used to physically join the metallic electrode to the dielectric insulator, in order to minimize adverse triple point-related phenomena. It has also been recognized that it would be advantageous to develop a vacuum tube for a mobile, miniature x-ray source that would provide better focus and control of the electron beam, thereby offering better performance of the device as an x-ray source.

The invention provides for an x-ray source that has an evacuated tube (that can have a length less than approximately 3 inches, and a diameter or width less than approximately 1 inch). An anode is disposed in the tube and includes a material configured to produce x-rays in response to impact of electrons. A cathode is disposed in the tube opposing the anode (and can include a low-power consumption cathode element) configured to produce electrons accelerated towards the anode in response to an electric field between the anode and the cathode. A flange extends from the cathode toward the anode, and has a smaller diameter than the evacuated tube so that a space is formed between the flange and the dielectric tube. The flange extends closer to the anode than the "triple point" interface between the cathode and the tube thus forming a lower-field region between the evacuated tube and the flange.

The present invention also provides for a method for making an x-ray source device including joining an anode to an end of an evacuated tube. The anode can include a material configured to produce x-rays in response to impact of electrons. A cathode can be positioned at an opposite end of the evacuated tube from the anode. The cathode can have an annular flange that can extend from the cathode into the tube toward the anode. The cathode can be joined to the evacuated tube with the annular flange shielding the interface.

Additional features and advantages of the invention will be apparent from the detailed description which follows, taken in conjunction with the accompanying drawings, which together illustrate, by way of example, features of the invention.

DETAILED DESCRIPTION

Figure 1:
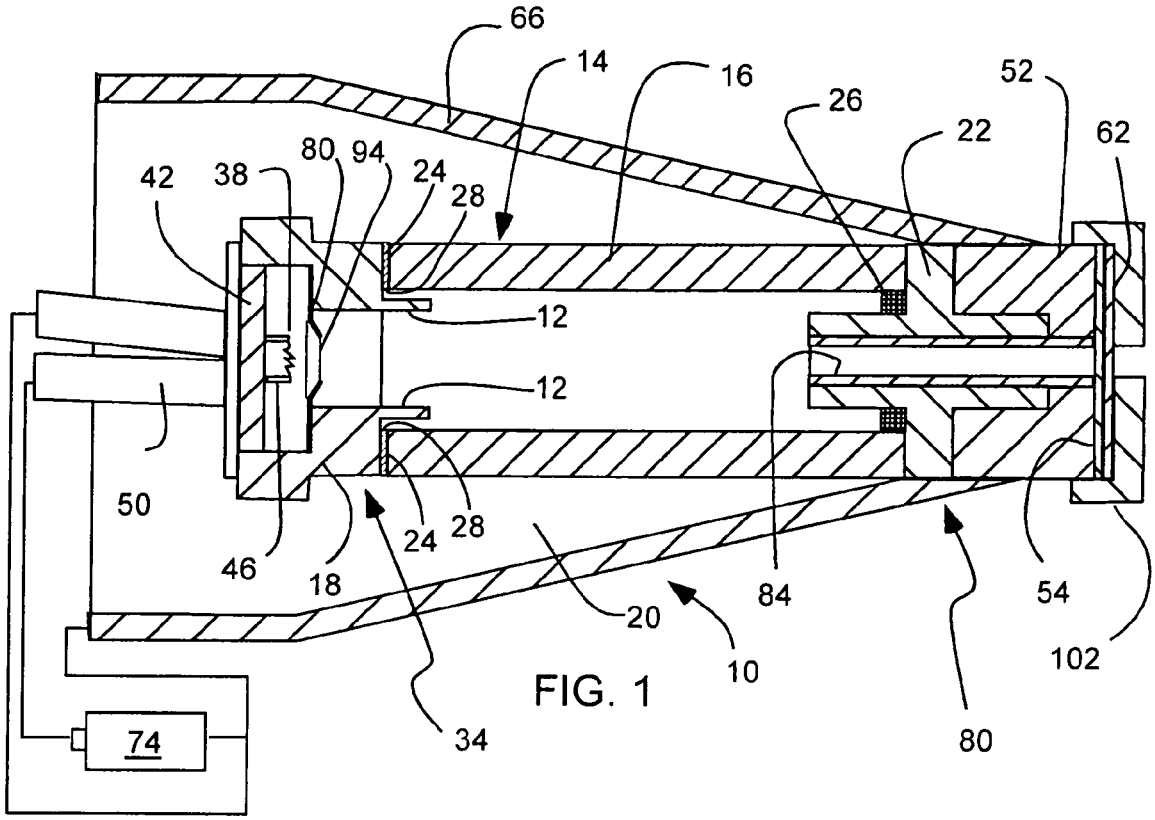
FIG. 1 is a cross-sectional side view of a mobile, miniature x-ray source in accordance with an embodiment of the present invention.
Figure 2:
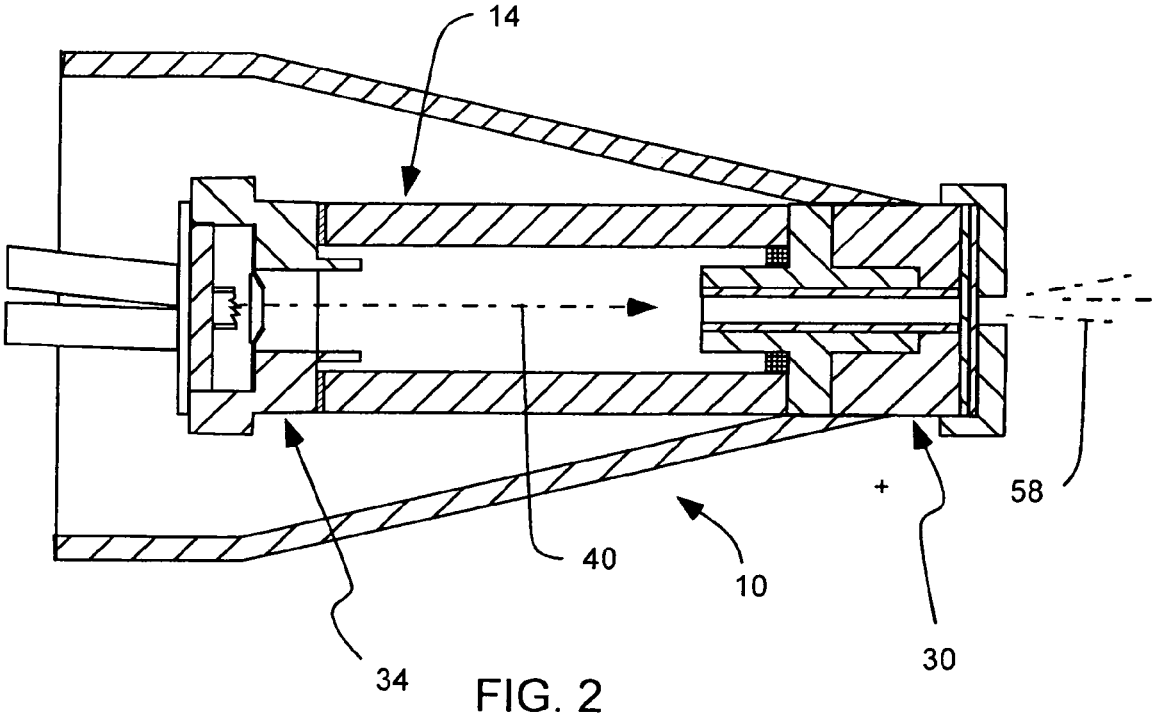
FIG. 2 is a cross-sectional schematic view of the x-ray source of FIG. 1.
Figure 3:
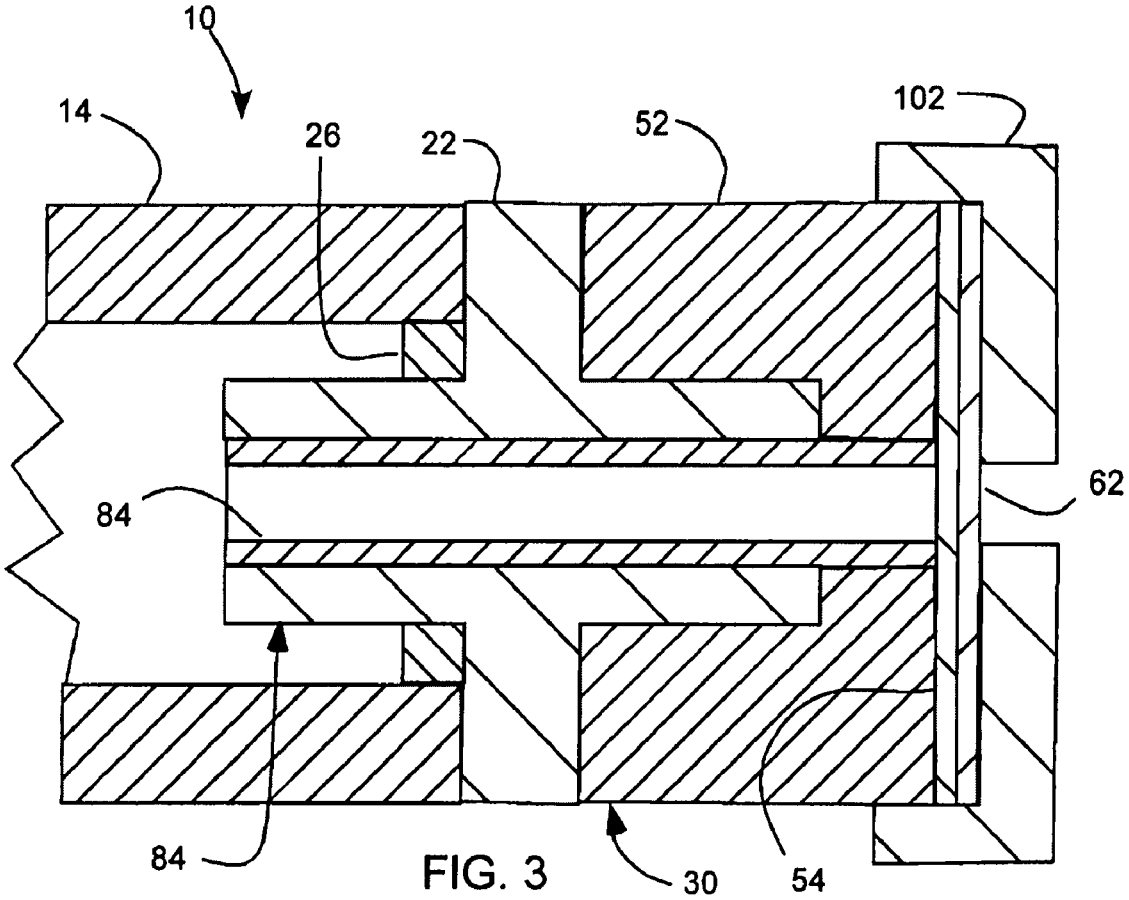
FIG. 3 is a partial cross-sectional side view of the x-ray source of FIG. 1.
Figure 4:
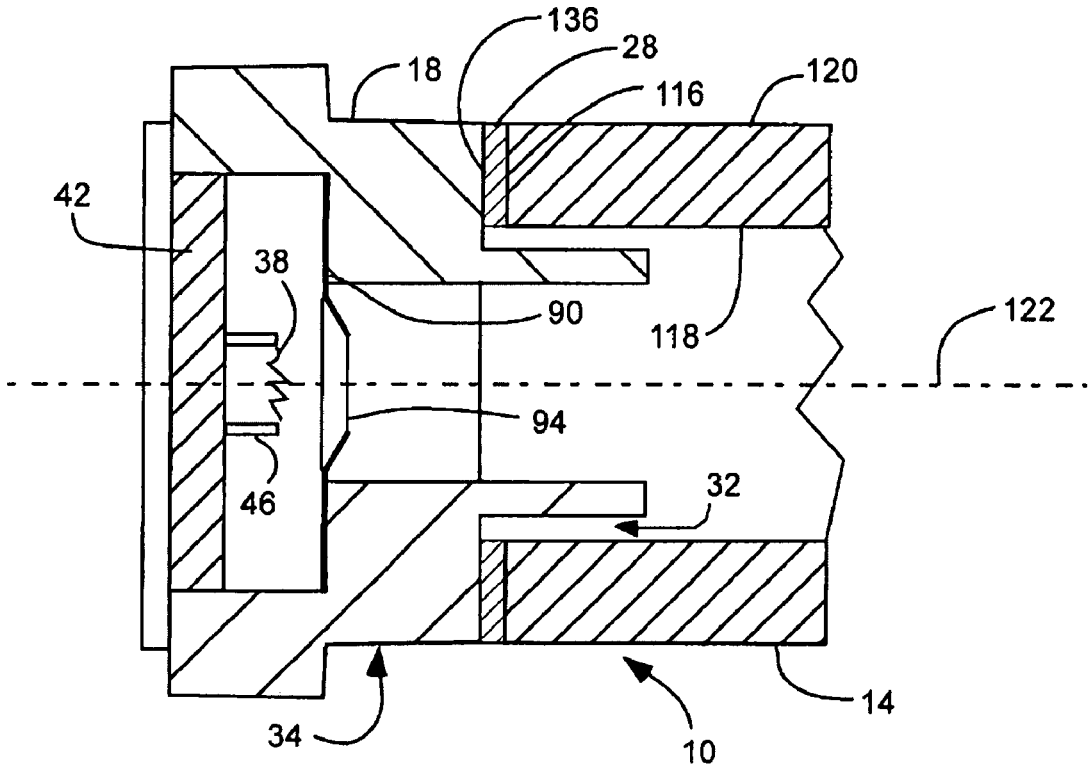
FIG. 4 is a partial cross-sectional side view of the cathode of FIG. 1.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1-4, a mobile, miniature x-ray source, indicated generally at 10 is shown, in accordance with the present invention. Certain aspects of such an x-ray source are disclosed in U.S. Pat. Nos. 6,661,876 and 7,035,379, which are incorporated herein by reference. The x-ray source 10 can include a low power consumption cathode element suitable for use with a battery power source to allow the x-ray source to be mobile for field applications and/or an anode optic creating a field free region to prolong the life of the cathode element. Thus, the x-ray source 10 can include an anode optic to create a field-free region at the anode for resisting positive ion acceleration back towards the cathode element, to resist sputter-erosion of the cathode element and to increase the life of the cathode element. "Field applications", such as X-ray fluorescence (XRF) of soil, water, metals, ores, well bores, etc., as well as diffraction and plating thickness measurements, are fields that can benefit from such an x-ray source 10.

The x-ray source 10 includes a dielectric evacuated tube or bulb 14. The x-ray source 10 can be a transmission-type x-ray source, and the tube 14 can be a transmission type x-ray tube, as shown. The tube 14 can include an elongated cylinder 16, and in one aspect is formed of a ceramic material, such as aluminum oxide. Ceramic is believed to be superior to the traditionally used glass because of its dimensional stability and its ability to withstand higher voltages. To remove embedded gas, the ceramic is pre-treated by vacuum heating. Extensions 18 and 22 can be attached at opposite ends of the tube 14. The extensions 18 and 22 can be formed of a metal material and brazed to the ceramic tube 14.

A getter 26 or getter material is disposed in the tube 14, and can be attached to the extension 22 to remove residual gasses in the tube after vacuum sealing. The getter 26 can be positioned in a field free position or region, as described in greater detail below. If high cleanliness standards are maintained and evacuation is performed properly, a getter may be unnecessary for tubes with thermionic emitters. The getter can be formed of ST 122/NCF, a Ti/Zr/V/Fe alloy. It can be activated by heating for a period of up to 24 hours. The getter configuration is shown by way of example only, and can be disposed in a different location than that described.

As stated above, the x-ray source 10 can be mobile and suited for field applications. The x-ray tube or bulb 14 advantageously has a length less than approximately 3 inches, and a diameter or width less than approximately 1 inch, to facilitate mobility and use in field applications.

An anode, indicated generally at 30, and a cathode, indicated generally at 34, are disposed in and/or form part of the tube 14. The anode 30 and cathode 34 are disposed at opposite sides of the tube 14 opposing one another. An electric field is applied between the anode 30 and cathode 34. The anode 30 can be grounded, as described below, while the cathode 34 can have a voltage applied thereto. The cathode can be held at a negative high voltage relative to the anode. Alternatively, the anode can be held at a positive high voltage, while the cathode is grounded.

As stated above, the cathode can be a low power consumption cathode and includes a low-mass, low-power consumption cathode element or filament 38. The cathode element 38 can be a thermionic emitter, such as a miniature coiled tungsten filament. The cathode element 38 produces electrons (indicated at 40 in FIG. 2) that are accelerated towards the anode 30 in response to the electric field between the anode 30 and the cathode 34. The cathode element advantageously has a low power consumption that is intended herein to have a power consumption less than approximately 1 watt. The lower power consumption of the cathode element 38 allows the x-ray source 10 to be battery powered, and thus mobile. In addition, the cathode element advantageously has a low-mass less than approximately 100 micrograms.

A header or end cap 42 can be attached to the extension 18 to support the cathode element 38. Pins or posts 46 can extend through the header or end cap 42, and can support the cathode element 38 therebetween. High voltage wires 50 can be electrically coupled to the pins 46, and thus the cathode element.

A potential of approximately 1 volt across the filament drives a current of about 200 mA, which raises the temperature to about 2300 C. This temperature is cool compared to most thermionic sources, but it provides sufficient electron emission for the intended applications of the x-ray tube. For example, only 20 μA are required to generate sufficient fluorescence from an alloy to saturate a semiconductor detector. Even higher emission efficiency is obtained if the tungsten cathode is coated with mixed oxides of alkaline earths (e.g. Cs, Ca, or Ba). They do, however, allow operation at temperatures as low as 1000 K. Such coated cathodes can still have a low mass as described above.

There are numerous advantages to this cool, coiled tungsten emitter compared to the conventional hot hairpin type. The cooler wire does not add as much heat, and this eliminates the need for an inconvenient cooling mechanism. The lower temperature reduces tungsten evaporation, so tungsten is not deposited on the anode, and the wire does not become thin and break. The cool tungsten coil, however, does not fall below the Langmuir limit, so space charge can accumulate between it and the Wehnelt optic or cathode optic, described below.

An end piece 52 can be disposed on the extension 22 at the anode 30. The end piece 52 can form a window support structure. The extension 22 can be formed from kover while the end piece 52 can be formed of monel. A bore can be formed through the extension 22 and the end piece 52 through which the electrons 40 pass.

A window or target 54 is disposed at the anode 30 of the end piece 52 to produce x-rays (indicated at 58 in FIG. 2) in response to impact of electrons 40. The window or target 54 can include an x-ray generating material, such as silver. The window or target 54 can be a sheet or layer of material disposed on the end of the anode 30, such as a 2-μm-thick silver. When electrons 40 form the cathode 34 impact the window or target 54 characteristic silver x-ray emission 58 is largely of the same wavelengths as the popular $^{109}$Cd radioactive x-ray sources.

A filter 62 can be used to remove low-energy Bremsstrahlung radiation. The filter 62 can be disposed at the anode 30 on the target material 54. The filter 62 can include a filter material, such as beryllium. In addition, the filter can be a thin layer or sheet, such as 130 μm of beryllium. The filter 62 or material thereof can coat the window or target 54. With such a configuration, silver L lines may be emitted, but they are absorbed after traveling a very short distance in air. It will be appreciated that additional filtering can be added after or instead of the beryllium. For example, one could use a balanced filter of the type described by U. W. Arndt and B. T. M. Willis in *Single Crystal Diffractometry,* Cambridge University Press, New York, 1966, p. 301.

The various components described above, such as the cylinder 16, the extensions 18 and 22, the end cap 42, the end piece 52, and the window or target 54 form the evacuated tube 14. A shield 66 can be disposed around the tube 14 to provide electrical shielding and shielding from stray x-rays. The shield 66 can be electrically coupled to the anode 30 to provide a ground for the anode. In addition, the shield 66 can be metallic to be conductive and shield x-rays. The shield 66 can be a tubular or frusto-conical shell to allow insulation between the x-ray tube 14 and the shield while contacting the anode 30. A space 20 between the shield 66 and the tube 14 can be potted with a potting compound, such as silicone rubber. In one aspect, the potting material has high thermal conductivity and can include high thermal conductivity materials, such as boron nitride.

The x-ray source 10 also can include a battery operated, high voltage power supply or battery power source, represented by 74, electrically coupled to the anode 30, the cathode 34, and the cathode element 38. The battery power source 74 provides power for the cathode element 38, and the electric field between the anode 30 and the cathode 34. The battery power source 74 and the low-power consumption cathode element 38 advantageously allow the x-ray source to be mobile for field applications.

In analytical applications, it is important to maintain a constant intensity of the x-ray emission. Therefore, a feature of the power supply is the stability that is maintained by feedback that is proportional to the emission current. Any drift in the resistivity of the tube is quickly neutralized by this means so that the tube current remains constant. The power supply can be similar to that described in U.S. Pat. No. 5,400,385, but in the present invention, the power supply is small and battery powered.

In addition, the x-ray source 10 can include an anode optic, indicated generally at 80. The anode optic 80 is located in the x-ray tube 14 at the anode 30, and creates a field free region to resist positive ion acceleration back towards the cathode element 38. Although, the x-ray tube 14 is evacuated, and can include a getter 26, the impact of electrons 40 on the window or target 54 can heat the anode 30, causing the release of residual gas molecules. The electrons 40 from the cathode element 38, in addition to impacting the window or target 54 to produce x-rays 58, can also ionize the residual gas from the heated anode 30 to positive ions. Normally, such positive ions would be accelerated back to the cathode 34, and can sputter-erode the cathode element 38. Because the cathode element 38 is a low power consumption element, it can have a low mass. Thus, such sputter-erosion from the positive ions can significantly damage the cathode element, and detrimentally affect the life of the cathode element. The field free region created at the anode by the anode optic 80, however, resists the acceleration of positive ions back towards the cathode element 38, thus resisting sputter erosion of the cathode element, and improving the life of the cathode element and x-ray tube.

The anode optic 80 can include an elongated anode tube 84 disposed at the anode 30 and window or target 54. One end of the elongated anode tube 84 can be in contact, or immediately adjacent to, the window or target 54. The anode optic 80 and tube 84 are at the same electrical potential as the window or target 54 or the anode 30. Thus, the anode tube 84 and anode 30 can be grounded. The field free region can be formed in a hollow of the tube. The tube 84 can be formed of silver, and can have an inner diameter of 1.6-mm. The anode optic 80 operates on the diverging beam of electrons 40 to focus them at the window or target 54. The anode optic 80 can be focused by having the proper distance between its open end and the cathode. Focusing may be necessary to create a small spot where x-rays are emitted, and also to prevent stray electrons from striking the inside of the tube. If any stray electrons strike the inside of the tube, the resulting emission of x-rays is of the same wavelengths as those of the target, which is composed of the same material. The tube 84 should completely cover the extension 22 and the end piece 52. As stated above, the tube 84 should extend or reach all the way to the window or target 54, otherwise a halo of unwanted wavelengths can appear around the x-ray beam.

In one aspect, the anode tube 84 and the anode 30 can include the same material, or can be formed of the same material, to prevent contamination of the output spectrum. For example, the anode 30 and the anode tube 84 can be formed of silver, palladium, tungsten, rhodium, titanium, chromium, etc.

It will be appreciated that the anode optic 80 and the low-power consumption cathode element 38 work together to provide a mobile x-ray source. The lower-power consumption cathode element 38 allows for a battery power source, while the anode optic 80 resists untimely erosion of the low-power consumption cathode.

The anode and/or anode optic are shown by way of example only, and can have a different configuration from that shown.

The x-ray source 10 also can include a cathode optic 90 disposed near the cathode 34. The cathode optic 90 can include a disc disposed between the cathode 34 and anode 30. An aperture 94 can be disposed in the disc and aligned along a path of travel between the cathode element 38 and the window or target 54. An indentation can be formed in the disk and can surround the aperture. The disc can be formed of metal. The cathode optic 90 can be a type of Wehnelt optic, but its shape is the inverse of the reentrant Wehnelt (or IRW). The voltage of the cathode optic 90 can be independently controlled, but is kept at the cathode potential in the current configuration. The cathode optic 90 limits the divergence of the emitted electron stream sufficiently that the anode optic 80 or tube 84 can focus the electrons without the major aberrations present with the fully divergent beam. Although the coiled thermionic emitter is large compared to the hairpin type, the aperture of the cathode optic exposes an area of space charge that can be focused on the anode. In fact, this aperture and the aperture of the anode optic are at different electrical potentials, and they form an electrostatic lens. The electron beam focus at the anode is surprisingly tight. In addition, it is not necessary to center the filament in this configuration because the cathode optic positions the source of electrons with respect to the anode.

Without the anode and cathode optics 80 and 90, the electron beam is weak and diffuse at the target. Only about 30% of the current emitted by the filament actually strikes the window. By contrast, if both the anode and cathode optics are present, more than 60% of the emission current strikes the anode target. What is more, the filament is imaged on the target with close to a 1:1 magnification. The result is emission of x-rays from a spot that has only a 0.3 mm diameter. This is far smaller than the size of typical x-ray sources. In addition, the x-rays are generated within the thin window so the distance between the point where the x-rays arise and the sample can be as short as a few millimeters. In another aspect, a Pierce-type electron gun can replace the cathode optic. The x-ray tube advantageously produces a sub-millimeter spot on the anode from which x-rays are emitted. In addition to being important for micro-XRF applications, a small X-ray source can be necessary for high-resolution imaging and for accurate crystallography.

An x-ray collimator 102 can be disposed on the end of the x-ray tube 14 at the anode 30 to direct x-rays in a desired direction. The collimator 102 can be disposed on the target 54 or filter 62. The collimator 102 includes a bore therethrough aligned with the path from the cathode element 38 to the window or target 54. The collimator 102 intercepts x-rays that exit at angles that are large relative to the window normal. The collimator 102 can be formed of silver to prevent the generation of unwanted x-ray wavelengths. The x-ray collimator 102 can be held at ground potential to avoid the possibility of electric shock to the operator of the device.

In addition to the field free region created at the anode 30 by the anode optic 80 and the focusing ability of the cathode optic 90, described above, the geometry of the cathode 34 can further protect and prolong the life of the cathode element as well as enhance the properties of the beam. For example, the extension 18 can be of the same material as the cathode 34, and can be an integral part of the cathode 34.

Additionally, the extension 18 can have an annular flange 12 that extends into the tube 14 towards the anode 30. The flange 12 can have a smaller outer diameter than the inner diameter of the tube 14 so that the flange 12 does not contact the tube 14, but leaves an annular space 32 between the flange 12 and the tube 14.

In one aspect, the interface 28 between the cathode 34 or extension 18 and the evacuated tube 14 can be formed by a substantially flat face 136 of the cathode 34 or extension 18 and a substantially flat face of 116 the evacuated tube 14. In the assembled interface configuration, the flat face 136 of the cathode 34 can oppose, or be an opposing face, to the flat face 116 of the tube 14. The opposing faces can extend between an inner diameter 118 and an outer diameter 120 of the evacuated tube 14. The opposing faces can also extend at a substantially orthogonal angle with respect to a longitudinal axis 122 of the evacuated tube.

A brazing material 24 can be used to braze the metal material of the extension 18 or cathode 34 to the ceramic tube 14. The point of intersection between the extension 18, the brazing material 24, and the tube 14 can form a triple point interface 28. The triple point interface 28 can be located outside the outer diameter of the flange 12 and farther away from the anode 30 than the flange 12. Brazing materials are typically metallic and they can distort the electric fields in the tube unless they are placed in a field-free region. Thus, with the flange 12 extending beyond the axial location of the triple point interface 28 and closer to the anode 30, a field free region can be created between the flange 12 and the tube 14, and the triple point interface 28 including the brazing material 24 can be located within the field free region.

Figure 5:
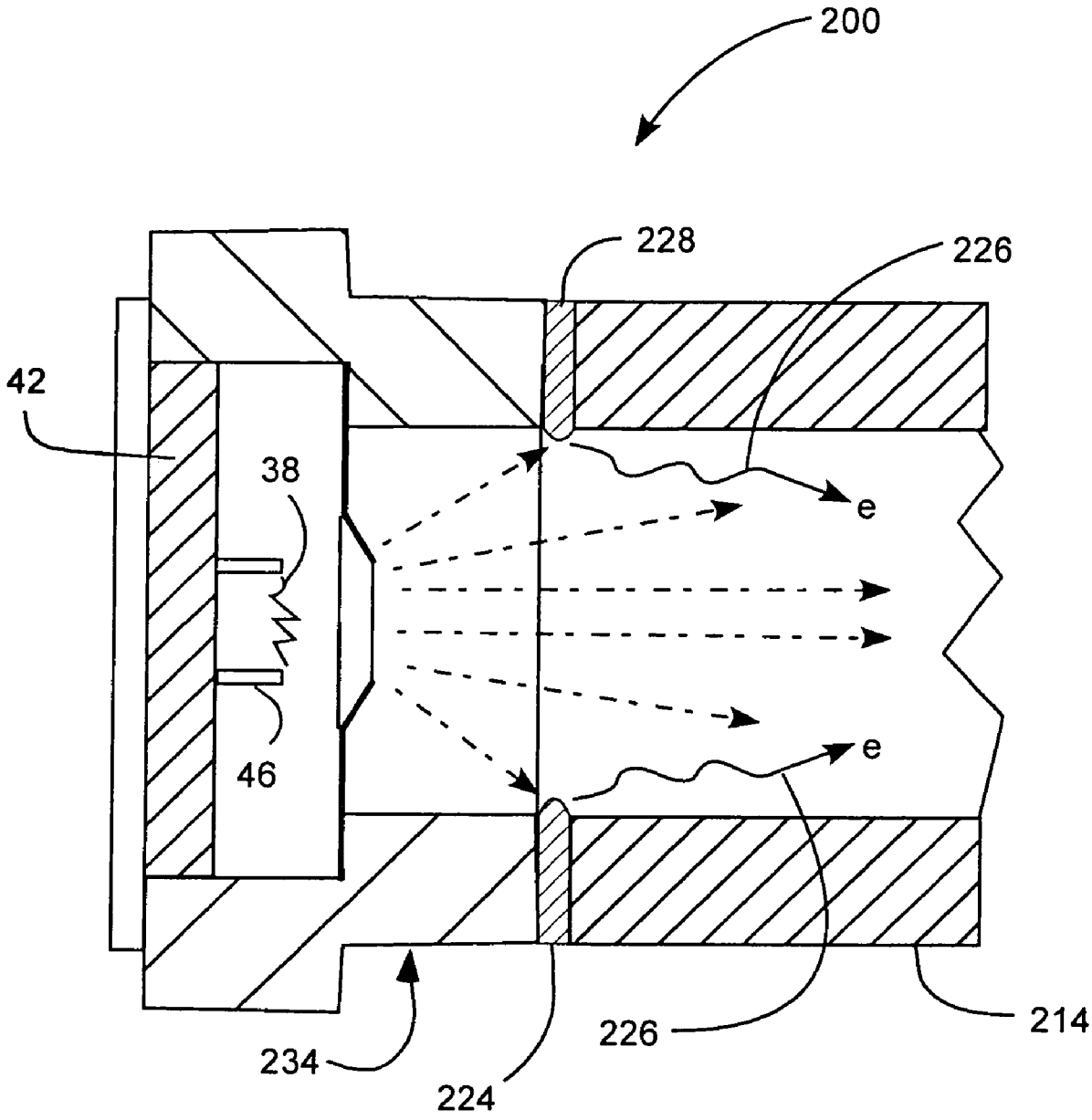
FIG. 5 PRIOR ART
FIG. 5 is a cross sectional side view of a prior x-ray source.

In contrast, as illustrated in FIG. 5, prior X-ray sources, illustrated generally at 200, do not have a flange positioned protectively around the triple point interface 228. Thus, when electric fields are generated in the tube 214, electrons can interact with the brazing material 224 in the triple point interface to produce unwanted and unintended field emissions, illustrated generally by arrows 226.

There are many advantages to placing a flange 12 adjacent the tube 14 and triple point interface 28. The triple point interface 28 can be located substantially outside the intensive electric field generated by the cathode 34, thereby reducing the potential for electric arcing between the cathode 34 and the adjacent materials including the brazing material 24 in the triple point interface 28. Thus, it can be possible to increase the power of the x-ray source while avoiding arcing. Additionally, the flange 12 can shield the triple point interface 28 from the flow of the electrons from the cathode 34 to the anode 30. In this way, the triple point interface 28 is located, in a field free region away from the accelerated electron flow, thereby reducing unintended field emissions since electrons are less likely to be exposed to the disruption of the brazing material 24 of the triple point interface 28.

Furthermore, the since the outer diameter of the flange 12 is smaller than the inner diameter of the tube 14, the flow of the brazing material 24 can be better managed by the space 32 created between the flange 12 and the tube 14 to minimize the effects of the brazing material 24 in the triple point interface 28. Specifically, overfill or extra brazing material 24 can be contained in the space 32 and still remain out of the electron field path. In contrast, if the flange were immediately adjacent the tube 14 with no space between, the brazing material could wick up the interface between the tube and the flange and become exposed to the electric field and electron path of the beam. Additionally, with the flange 12 extending into the tube 14 and closer to the anode 30, the flange 12 can assist the cathode optic 90 in focusing the electron beam from the cathode 34 to the anode 30, thereby providing more flux over a smaller beam width resulting in better optical properties of the x-ray beam.

Figure 6:
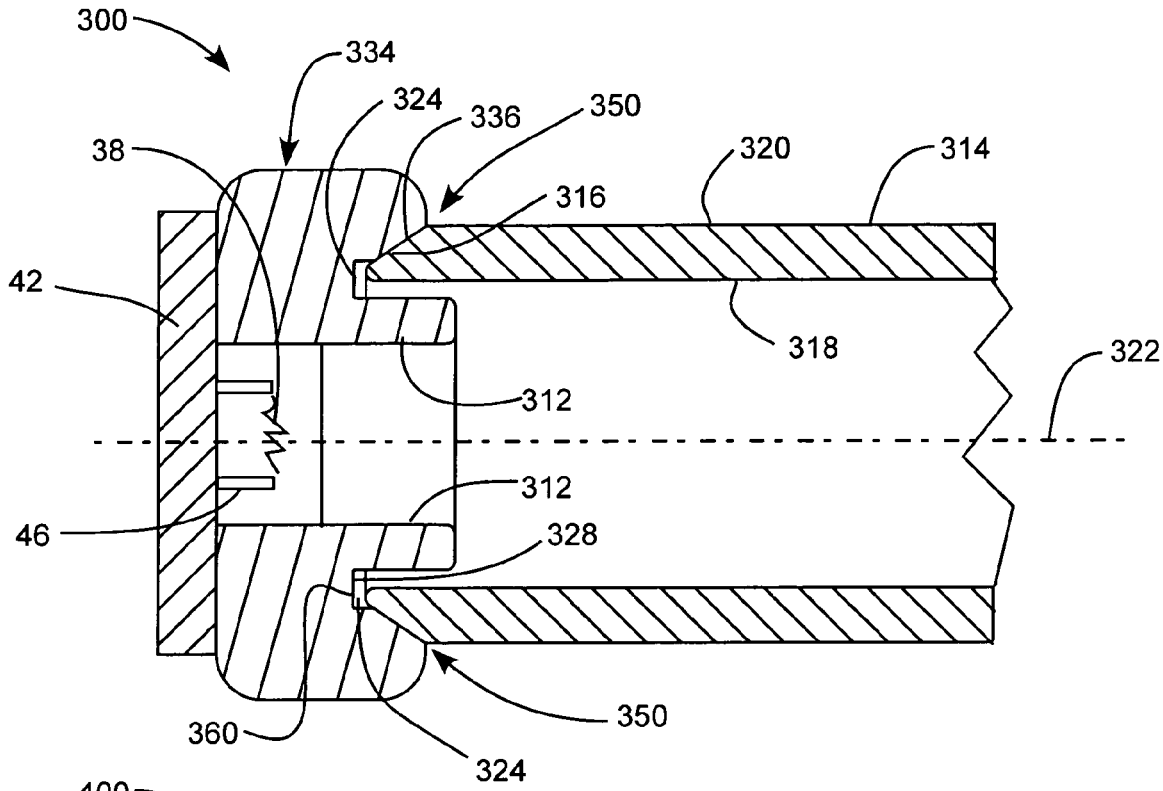
FIG. 6 is a cross sectional side view of another cathode of a mobile, miniature x-ray source in accordance with another embodiment of the present invention.

Illustrated in FIG. 6, another mobile, miniature x-ray source, indicated generally at 300 is shown, in accordance with another embodiment of the present invention. The miniature x-ray source 300 can be similar in many respects to the miniature x-ray source 10 described above and shown in FIGS. 1-4, and thus the above description is incorporated herein and applies above. The miniature x-ray source can have a header or end cap 42, and pins or posts 46 that support a cathode element 38. The cathode 334 or extension can be joined to an evacuated tube 314 by a joining material 324, such as brazing. The cathode can also include an annular flange 312 that can extend from the cathode 334 or extension toward the anode with a space between the flange and the evacuated tube 314. The space can provide a field free region and the flange 312 can shield the triple point interface 328 from unintended field emissions.

Additionally, the interface 328 between the cathode 334 and the evacuated tube 314 can be formed by a substantially flat face 336 of the cathode 334 and a substantially flat face 316 of the evacuated tube 314. In the assembled interface configuration, the flat face 336 of the cathode 334 can oppose, or be an opposing face, to the flat face 316 of the tube 314. The opposing faces 336 and 316, and thus the interface 328 can extend substantially between an inner diameter 318 and an outer diameter 320 of the evacuated tube 314. Furthermore, the flat faces 336 and 316 can be oriented at an oblique angle with respect to a longitudinal axis 322 of the evacuated tube 314, and can define an annular beveled interface, indicated generally at 350, between the cathode 334 and the evacuated tube 314.

The cathode 334 or extension can also include an annular groove 360 disposed adjacent the outer diameter of the annular flange 312. The annular groove 360 can be configured to contain excess joining material 324 from the triple point interface 328 between the cathode 334 and the evacuated tube 314.

Furthermore, the annular groove 360 can have a larger outer diameter than an inner diameter of the tube 314 so that the inner diameter of the tube 314 extends over the annular groove 360. In addition, the inner diameter of the tube 314 can be greater than the face 336 of the cathode 334 or extension. Thus, the tube 314 itself can shield the triple point.

Figure 7:
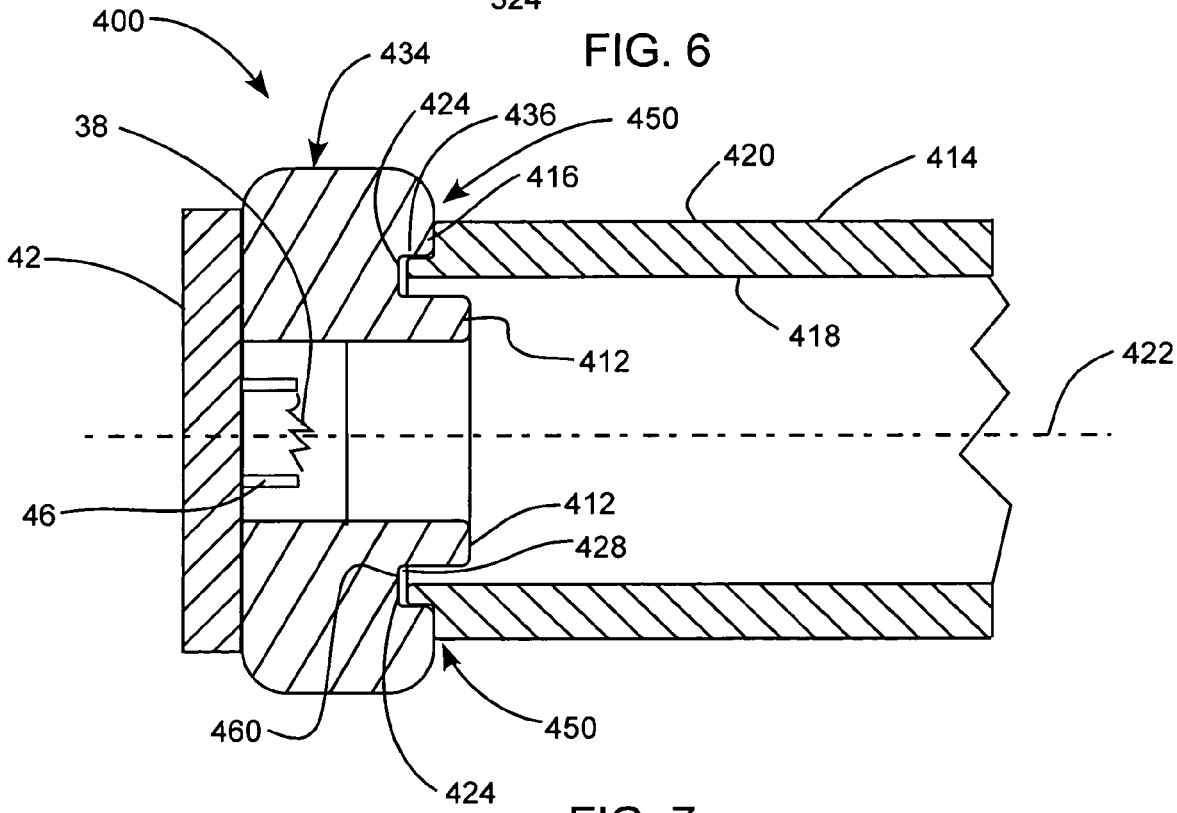
FIG. 7 is a cross sectional side view of another cathode of a mobile, miniature x-ray source in accordance with another embodiment of the present invention.

Illustrated in FIG. 7, another mobile, miniature x-ray source, indicated generally at 400 is shown, in accordance with another embodiment of the present invention. The miniature x-ray source 400 can be similar in many respects to the miniature x-ray source 10 described above and shown in FIGS. 1-4, and thus the above description is incorporated herein and applies above. The miniature x-ray source can have a header or end cap 42, and pins or posts 46 that support a cathode element 38. The cathode 434 or extension can be joined to an evacuated tube 414 by a joining material 424, such as brazing. The cathode or extension can also include a flange 412 that can extend from the cathode 434 toward the anode with a space between the flange and the evacuated tube 414. The space can provide a field free region and the flange 412 can shield the triple point interface 428 from unintended field emissions.

Additionally, the interface 428 between the cathode 434 or extension and the evacuated tube 414 can be formed by a substantially flat face 436 of the cathode 434 and a substantially flat face 416 of the evacuated tube 414. In the assembled interface configuration, the flat face 436 of the cathode 434 can oppose, or be an opposing face, to the flat face 416 of the tube 414. The opposing faces 436 and 416, and thus the interface 428 can extend substantially between an inner diameter 418 and an outer diameter 420 of the evacuated tube 414. Furthermore, the flat faces 436 and 416 can be oriented at an oblique angle with respect to a longitudinal axis 422 of the evacuated tube 414, and can define a corner in the interface, indicated generally at 450, between the cathode 434 and the evacuated tube 414.

The cathode 434 can also include an annular groove 460 disposed adjacent the outer diameter of the annular flange 412. The annular groove 460 can be configured to contain excess joining material 424 from the triple point interface 428 between the cathode 434 and the evacuated tube 414.

Furthermore, the annular groove 460 can have a larger outer diameter than an inner diameter of the tube 414 so that the inner diameter of the tube 414 extends over the annular groove 460. In addition, the inner diameter of the tube 414 can be greater than the face 436 of the cathode 434 or extension. Thus, the tube 414 itself can shield the triple point.

The present invention also provides for a method for making an x-ray source device including joining an anode to an end of an evacuated tube. The anode can include a material configured to produce x-rays in response to impact of electrons. A cathode can be positioned at an opposite end of the evacuated tube from the anode. The cathode can have an annular flange that can extend from the cathode into the tube toward the anode. The annular flange can have a smaller diameter than an inner diameter of the evacuated tube to form a space between the flange and the evacuated tube. The annular flange can extend closer to the anode than an interface between the cathode and the tube, and can include a cathode element configured to produce electrons accelerated towards the anode in response to an electric field between the anode and the cathode. Additionally, the cathode can be joined to the evacuated tube with the annular flange shielding the interface.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. An x-ray source device, comprising:

a) an evacuated dielectric tube having an outer diameter and a constant inner diameter;

b) an anode, disposed at an end of the tube, including a material configured to produce x-rays in response to impact of electrons; and c) a cathode, disposed at an opposite end of the tube opposing the anode, including a cathode element configured to produce electrons accelerated towards the anode in response to an electric field between the anode and the cathode;

d) an interface formed between the cathode and the end of the tube, the interface being disposed between the cathode and the anode;

e) the interface at the outer diameter of the tube being closer to the anode than the interface at the inner diameter of the tube; and f) an annular flange, extending from the cathode toward the anode within the tube, having a smaller diameter than an inner diameter of the evacuated tube to form an annular space between the flange and the evacuated tube, and extending closer to the anode than the interface between the cathode and the tube.

2. A device in accordance with claim 1, further including a joining material disposed in an interface between the cathode and the evacuated tube to join the evacuated tube to the cathode.

3. A device in accordance with claim 1, further comprising:

a field-free region, positioned between the flange and the tube, configured to resist arcing and field emission between the cathode and adjacent materials.

4. A device in accordance with claim 1, wherein the tube has a length less than approximately 3 inches, and a diameter or width less than approximately 1 inch.

5. A device in accordance with claim 1, wherein the cathode is a low-power consumption cathode, and wherein the cathode element has a low power consumption less than approximately 1 watt.

6. A device in accordance with claim 1, further comprising a battery power source.

7. A mobile, miniature x-ray source device, comprising:

a) an evacuated dielectric tube, with an outer diameter and a constant inner diameter, having a length less than approximately 3 inches, and a diameter or width less than approximately 1 inch;

b) an anode, disposed at an end of the tube, including a material configured to produce x-rays in response to impact of electrons; and c) a low-power consumption cathode, disposed at an opposite end of the tube opposing the anode, including a cathode element configured to produce electrons accelerated towards the anode in response to an electric field between the anode and the cathode, the cathode element having a low power consumption less than approximately 1 watt;

d) an interface formed between the cathode and the end of the tube, the interface being disposed between the cathode and the anode;

e) the interface at the outer diameter of the tube being closer to the anode than the interface at the inner diameter of the tube; and f) an annular flange, extending from the cathode toward the anode within the tube, having a smaller diameter than an inner diameter of the evacuated tube to form an annular space between the flange and the evacuated tube, and extending closer to the anode than an interface between the cathode and the tube.

8. A device in accordance with claim 7, further including a joining material disposed in an interface between the cathode and the evacuated tube to join the evacuated tube to the cathode.

9. A device in accordance with claim 1, wherein the annular flange is integrally formed with the cathode and forms a portion of the cathode.

10. A device in accordance with claim 1, wherein the interface between the cathode and the tube is closer to the anode than is the cathode element.

11. A device in accordance with claim 7, wherein the annular flange is integrally formed with the cathode and forms a portion of the cathode.

12. A device in accordance with claim 1, further comprising an annular groove disposed between the interface and the annular flange; the annular groove having an outer diameter greater than the inner diameter of the tube such that the tube extends over the annular groove.

13. A device in accordance with claim 1, wherein the interface is beveled.

14. A device in accordance with claim 1, wherein the interface includes a corner in the interface.

15. A device in accordance with claim 7, further comprising an annular groove disposed between the interface and the annular flange; the annular groove having an outer diameter greater than the inner diameter of the tube such that the tube extends over the annular groove.

16. A device in accordance with claim 7, wherein the interface is beveled.

17. A device in accordance with claim 7, wherein the interface includes a corner in the interface.

18. An x-ray source device, comprising:

a) an evacuated dielectric tube having an outer diameter and a constant inner diameter;

b) an anode, disposed at an end of the tube, including a material configured to produce x-rays in response to impact of electrons; and c) a cathode, disposed at an opposite end of the tube opposing the anode, including a cathode element configured to produce electrons accelerated towards the anode in response to an electric field between the anode and the cathode;

d) an interface formed between the cathode and an end of the tube, the interface being disposed between the cathode and the anode;

e) the interface at the outer diameter of the tube being closer to the anode than the interface at the inner diameter of the tube;

f) an annular flange, extending from the cathode toward the anode within the tube, having a smaller diameter than an inner diameter of the evacuated tube to form an annular space between the flange and the evacuated tube, and extending closer to the anode than the interface between the cathode and the tube; and g) an annular groove disposed between the interface and the annular flange, and having an outer diameter greater than the inner diameter of the tube such that the tube extends over the annular groove.

19. A device in accordance with claim 18, wherein the interface is beveled.

20. A device in accordance with claim 18, wherein the interface includes a corner in the interface.

21. A device in accordance with claim 18, wherein the tube has a length less than approximately 3 inches, and a diameter or width less than approximately 1 inch.

22. A device in accordance with claim 18, wherein the cathode is a low-power consumption cathode, and wherein the cathode element has a low power consumption less than approximately 1 watt.

23. A device in accordance with claim 18, further comprising a battery power source.

24. A device in accordance with claim 18, wherein the annular flange is integrally formed with the cathode and forms a portion of the cathode.

* * * * *